US007824077B2

(12) United States Patent
Chen et al.

(10) Patent No.: US 7,824,077 B2
(45) Date of Patent: Nov. 2, 2010

(54) LAMP STRUCTURE

(76) Inventors: Che-Kai Chen, 4F., No. 30, Lane 25, Wunhua St., Shulin City, Taipei County 238 (TW); Yao-Hung Wong, No. 171, Lingjhong Rd., Lingya District, Kaohsiung City 802 (TW); Sam Wu, 23 Tarrawonga St., Sunnybank 4109 (AU)

( * ) Notice: Subject to any disclaimer, the term of this patent is extended or adjusted under 35 U.S.C. 154(b) by 226 days.

(21) Appl. No.: 12/164,191

(22) Filed: Jun. 30, 2008

(65) Prior Publication Data

US 2009/0323351 A1 Dec. 31, 2009

(51) Int. Cl.
*F21V 29/00* (2006.01)

(52) U.S. Cl. ..... 362/345; 362/373; 362/294

(58) Field of Classification Search ..... 362/373, 362/294, 345, 310, 580, 547, 126, 218, 264, 362/800

See application file for complete search history.

(56) References Cited

U.S. PATENT DOCUMENTS 7,396,146 B2 * 7/2008 Wang ..... 362/294
7,524,089 B2 * 4/2009 Park ..... 362/294
7,670,028 B2 * 3/2010 Liu et al. ..... 362/294
2007/0297177 A1 * 12/2007 Wang et al. ..... 362/294
2008/0037255 A1 * 2/2008 Wang ..... 362/294
2008/0158887 A1 * 7/2008 Zhu et al. ..... 362/294
2008/0175003 A1 * 7/2008 Tsou et al. ..... 362/294
2009/0135613 A1 * 5/2009 Peng ..... 362/373
2009/0141500 A1 * 6/2009 Peng ..... 362/294

* cited by examiner

*Primary Examiner*—Bao Q Truong
(74) *Attorney, Agent, or Firm*—Alam Kamrath; Kamrath & Assocates PA

(57) ABSTRACT

A lamp structure has a slim light emitting source including at least one LED packaged on a multilayered printed circuit board type aluminum base. A funnel-shaped reflector is concaved toward a center thereof and defined with at least one hole for partially accommodating the LED. An inner surface of the reflector is coated to form a light reflecting surface. A flat lens includes a surface being treated with sand blast. A lamp housing has a receiving chamber for accommodation of the slim light emitting source, the reflector, the flat lens, and a driver. The lamp housing is formed with a plurality of heat dissipation fins. The driver is inserted in the other end of the receiving chamber of the lamp housing and has positive and negative leads connected to the slim light emitting source for enabling it to produce light.

3 Claims, 4 Drawing Sheets

LAMP STRUCTURE

BACKGROUND OF THE INVENTION

1. Field of the Invention

The present invention relates to a lamp structure and, more particularly, to a lamp structure with focused bright light, with its illumination angle as large as 180 degrees, and with a lamp which has a long life and good heat dissipation and is environmentally friendly.

2. Description of the Prior Art

Conventional lights, whether of the wall or ceiling type, are all big in size and occupy a lot of space. On top of that, if the light itself doesn't have an appealing appearance and a well-designed shape, it can't be in harmony with the surrounding decorations.

The present invention has arisen to mitigate and/or obviate the afore-described disadvantages.

SUMMARY OF THE INVENTION

The primary objective of the present invention is to provide a lamp structure with focused bright light, with its illumination angle as large as 180 degrees, and with a lamp which has a long life and good heat dissipation and is environmentally friendly.

To achieve the above objective, the lamp structure provided in accordance with the present invention comprises:

a slim light emitting source including at least one light emitting diode packaged on a multilayered printed circuit board type aluminum base;

a funnel-shaped reflector being concaved toward a center thereof, and in a bottom of the funnel-shaped reflector being defined at least one hole for partially accommodating a surface of the slim light emitting diode, with an inner surface of the funnel-shaped reflector being coated to form a light reflecting surface;

a flat lens whose surface is treated with sand blast; and a lamp housing including a receiving chamber, one end of which being accommodated with the slim light emitting source, the funnel-shaped reflector, and the flat lens, respectively, and the other end of which being provided for insertion of a driver, with an outer surface of the lamp housing being formed with a plurality of heat dissipation fins; with the driver being inserted in the other end of the receiving chamber of the lamp housing and having positive and negative leads connected to the slim light emitting source for making it produce light.

The light emitting diode is any color and is high power.

DETAILED DESCRIPTION OF THE PREFERRED EMBODIMENTS

The present invention will be clearer from the following description when viewed together with the accompanying drawings, which show, for purpose of illustration only, the preferred embodiment in accordance with the present invention.

Figure 1:
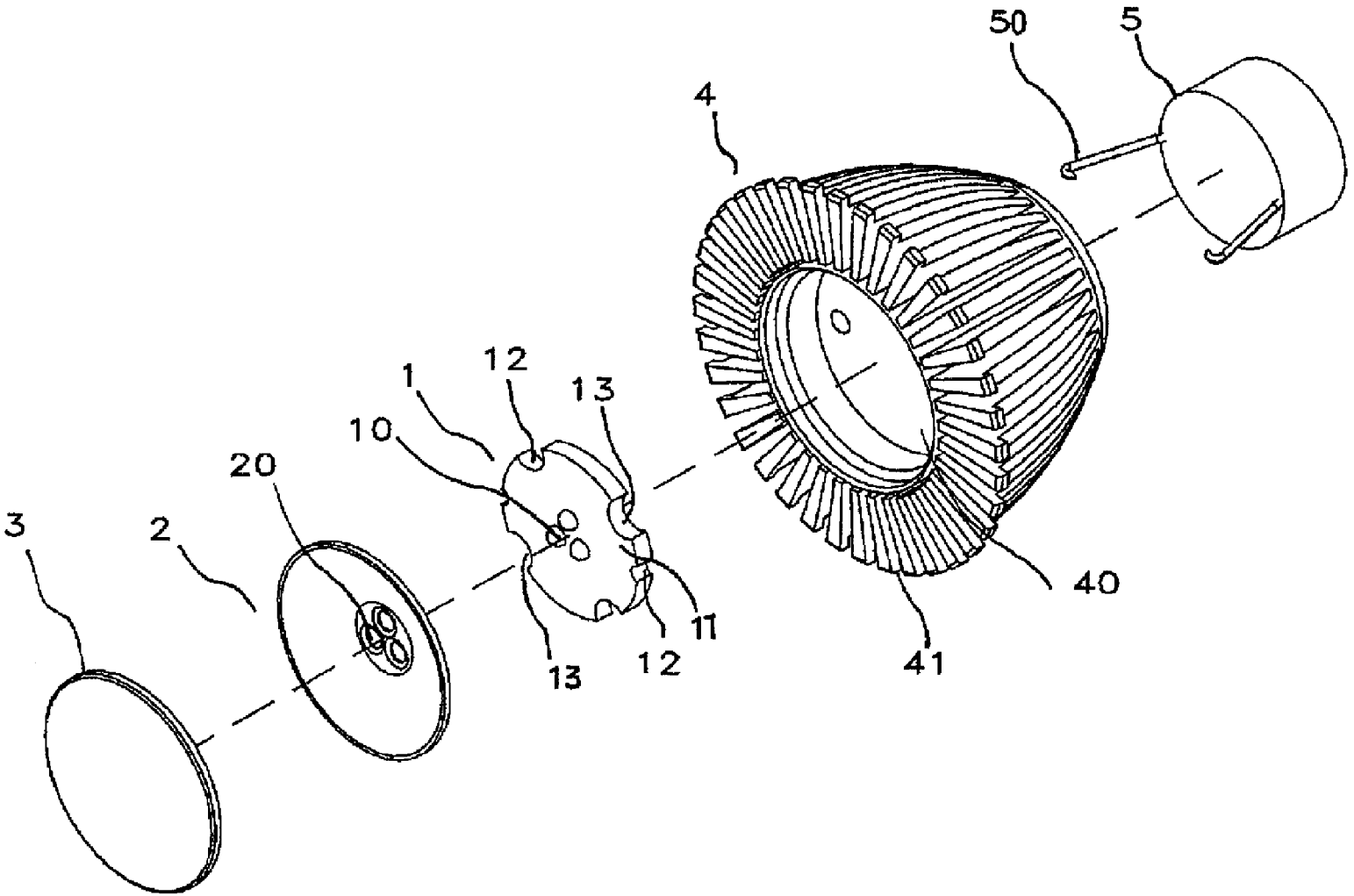
FIG. 1 is an exploded view of a lamp structure in accordance with a preferred embodiment of the present invention.

FIG. 1 is an exploded view of a lamp structure in accordance with a preferred embodiment of the present invention. The lamp structure comprises: a slim light emitting source 1, a reflector 2, a flat lens 3, a lamp housing 4 and a driver 5.

The light emitting source 1 includes one or more high power LED (light emitting diode) 10 packaged on a MPCB (multilayered printed circuit board) aluminum base 11, and the LED 10 can be any color. Around the periphery of the aluminum base 11 are oppositely arranged two locking grooves 12 for passage and electrical connection of the positive and negative leads 50 of the driver 5 and a plurality of gaps 13 for making it easier to take out the light emitting source 1 from the lamp housing 4 when replacement is required.

The reflector 2 is funnel-shaped and concaved toward the center thereof. In the bottom of the reflector 2 are defined one or more holes 20 for accommodation of a part of the surface of the LED 10. The inner surface of the reflector 2 is coated to form a light reflecting surface for adjusting the illumination angle, eliminating shade, and focusing the light generated from the light source while preventing waste of light.

The surface of the flat lens 3 is treated with sand blast to blend the light source and to carry out luminous reflectance, so that the illumination angle can be adjusted up to 180 degrees, ghosting is prevented, and the light source is emitted out in a focused way.

The lamp housing 4 includes a receiving chamber 40, one end of which is accommodated with the slim light emitting source 1, the reflector 2, and the flat lens 3, respectively, and the other end of which is provided for insertion of the driver 5. The outer surface of the lamp housing 4 is formed with a plurality of heat dissipation fins 41.

The driver 5 is inserted in the other end of the lamp housing 4 and has positive and negative leads 50 connected to the slim light emitting source 1 for making it produce light.

Figure 2:
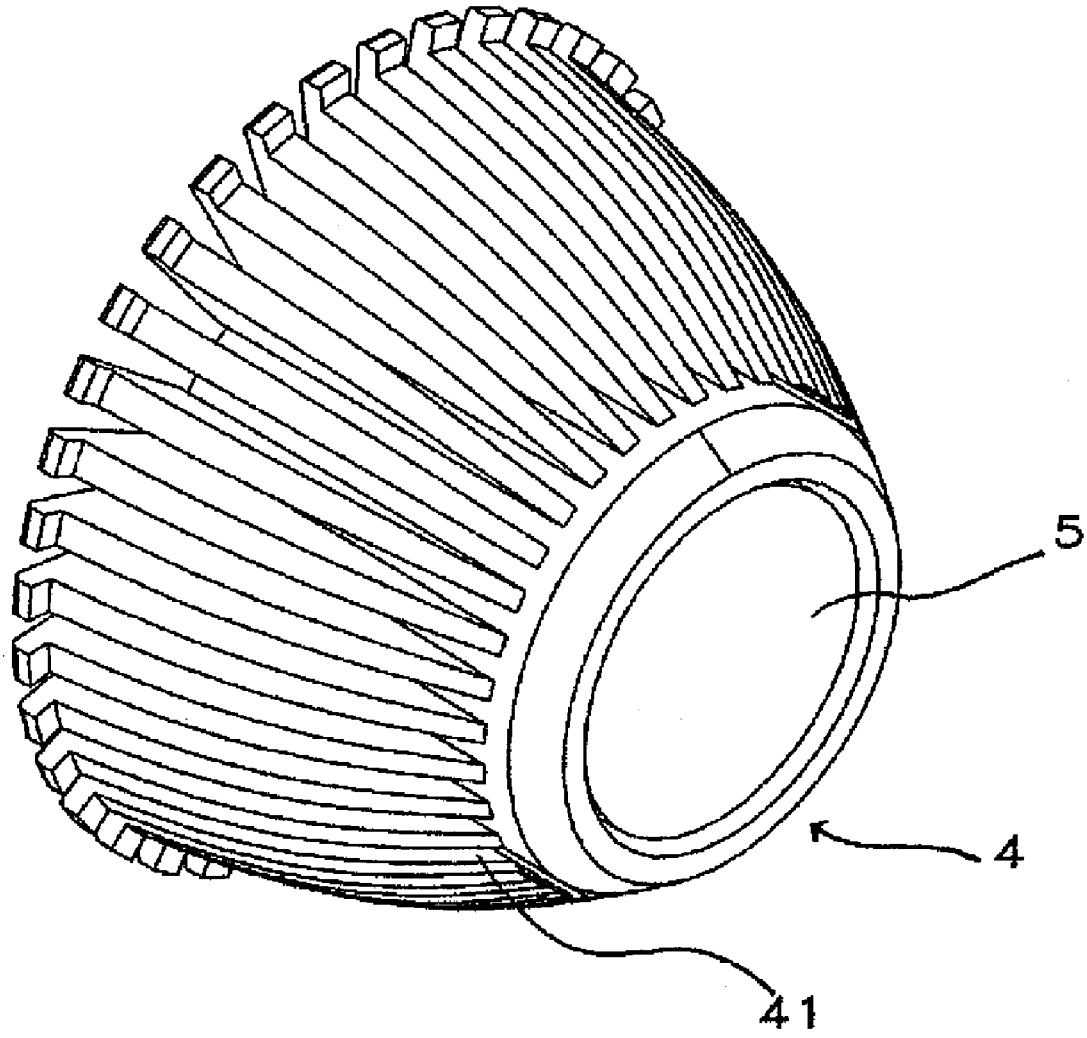
FIG. 2 is a perspective view of the lamp structure in accordance with the preferred embodiment of the present invention.
Figure 3:
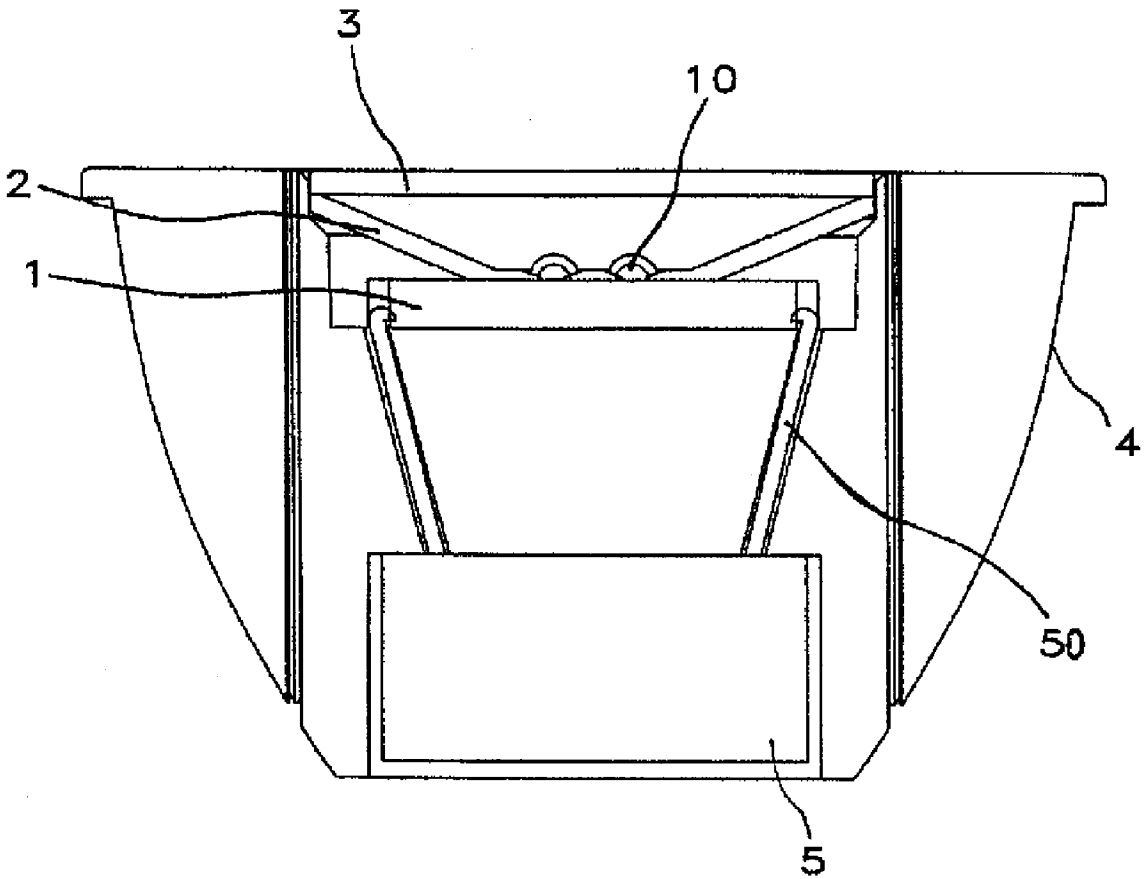
FIG. 3 is a cross sectional view of the lamp structure in accordance with the preferred embodiment of the present invention.
Figure 4:
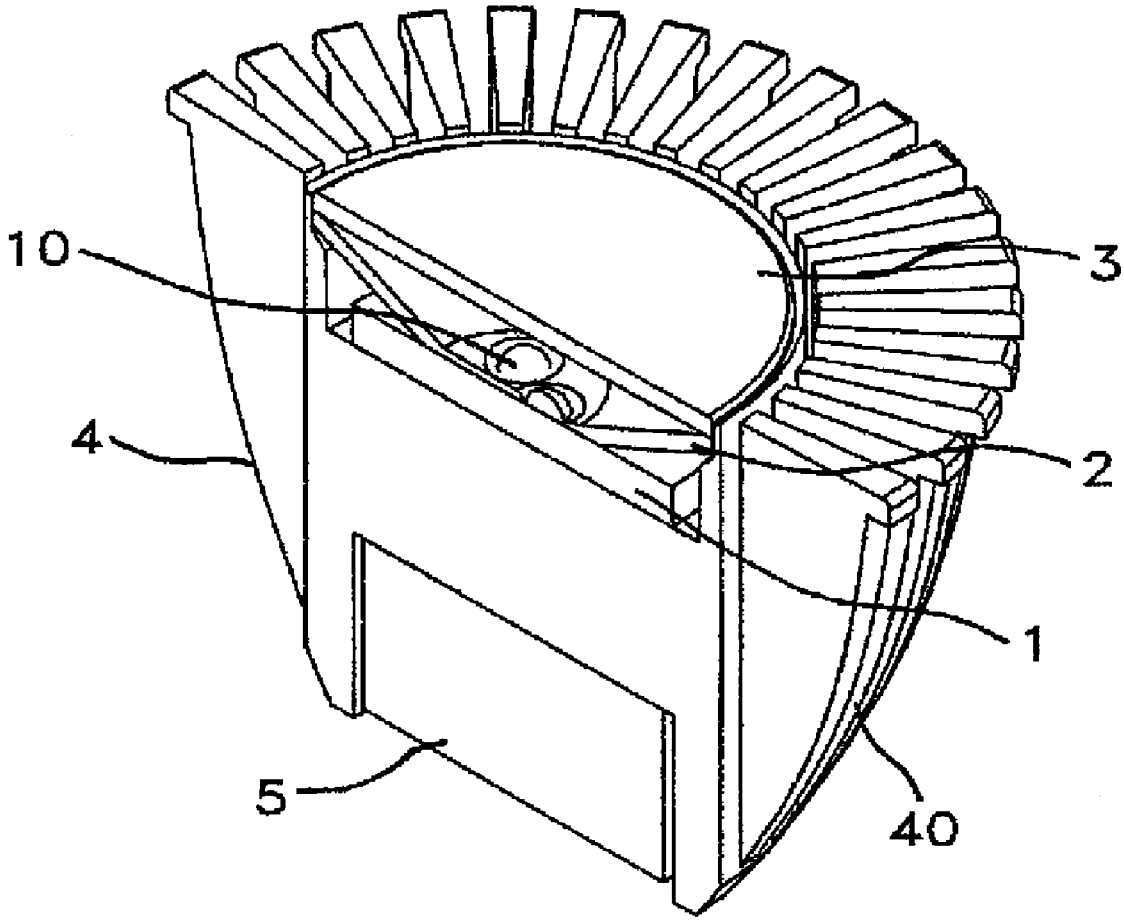
FIG. 4 is another cross sectional view of the lamp structure in accordance with the preferred embodiment of the present invention.

As shown in FIG. 2, which is a perspective view of a lamp structure in accordance with the preferred embodiment of the present invention, the light emitting source 1 is inserted in the receiving chamber 40 of the lamp housing 4. Then, the reflector 2 is inserted with its holes 20 aligned and engaged with the LEDs 10. After that, the flat lens 3 is assembled. Then, the driver 5 is inserted into the other end of the receiving chamber 40 with its positive and negative leads 50 extending into electrical contact with the light emitting source 1, as shown in FIGS. 3 and 4, thus forming a lamp.

When in use, the operating voltage of the lamp is 12 V. Because of the high power LEDs 10, the light emitting source 1 will produce bright enough light and has a long life. On top of that, the reflector 2 can adjust the illumination angle of the LEDs 10, illuminate shade, and focus the light of the light emitting source 1. Furthermore, the sand blasted flat lens 3 can blend the light emitting source 1 to have an illumination angle of 180 degrees. Thus, ghosting is prevented. Finally, the fins 41 around the outer periphery of the lamp housing 4 can effectively improve the heat dissipation efficiency.

While various embodiments in accordance with the present invention have been shown and described, it is clear to those skilled in the art that further embodiments may be made without departing from the scope of the present invention.

What is claimed is:

1. A lamp structure comprising:

a slim light emitting source including at least one light emitting diode packaged on a multilayered printed circuit board type aluminum base;

a funnel-shaped reflector being concaved toward a center thereof, and in a bottom of the funnel-shaped reflector being defined at least one hole for partially accommodating a surface of the slim light emitting diode, with an inner surface of the funnel-shaped reflector being coated to form a light reflecting surface;

a flat lens whose surface is treated with sand blast; and a lamp housing including a receiving chamber, one end of the receiving chamber being accommodated with the slim light emitting source, the funnel-shaped reflector, and the flat lens, respectively, and the other end of the receiving chamber being provided for insertion of a driver, with an outer surface of the lamp housing being formed with a plurality of heat dissipation fins, with the driver being inserted in the other end of the receiving chamber of the lamp housing and having positive and negative leads connected to the slim light emitting source for enabling the slim light emitting source to produce light, wherein the aluminum base is provided around a periphery thereof with two oppositely arranged locking grooves for passage and electrical connection of the positive and negative leads and with a plurality of gaps for taking out the slim light emitting source from the lamp housing when replacement is required.

2. The lamp structure as claimed in claim 1, wherein the slim light emitting diode is any color.

3. The lamp structure as claimed in claim 1, wherein the slim light emitting diode is high power.

* * * * *